US011259975B2

(12) United States Patent
O'Leary

(10) Patent No.: US 11,259,975 B2
(45) Date of Patent: Mar. 1, 2022

(54) APPARATUS PROVIDING EXTENSION OF A SURGICAL TABLE WIDTH ALLOWING ADAPTATION TO THE PARAMETERS OF THE SPECIFIC PATIENT

(71) Applicant: Breanne O'Leary, Cardiff, CA (US)

(72) Inventor: Breanne O'Leary, Cardiff, CA (US)

( * ) Notice: Subject to any disclaimer, the term of this patent is extended or adjusted under 35 U.S.C. 154(b) by 170 days.

(21) Appl. No.: 16/596,522

(22) Filed: Oct. 8, 2019

(65) Prior Publication Data

US 2020/0100963 A1 Apr. 2, 2020

Related U.S. Application Data

(60) Provisional application No. 62/745,334, filed on Oct. 13, 2018.

(51) Int. Cl.
*A61G 7/05* (2006.01)
*A61G 7/00* (2006.01)

(52) U.S. Cl.
CPC ..... *A61G 7/0513* (2016.11); *A61G 7/0514* (2016.11); *A61G 7/0519* (2016.11); *A61G 7/0507* (2013.01); *A61G 2203/20* (2013.01); *A61G 2203/32* (2013.01); *A61G 2203/36* (2013.01)

(58) Field of Classification Search
CPC .. A61G 7/0507; A61G 7/0512; A61G 7/0513; A61G 7/0514; A61G 7/0519; A61G 7/052; A61G 7/0521; A61G 7/0524
USPC ..... 5/616–618, 600, 185, 425, 428–430
See application file for complete search history.

(56) References Cited

U.S. PATENT DOCUMENTS 4,409,695 A * 10/1983 Johnston ..... A61G 7/015 5/428
5,083,332 A * 1/1992 Foster ..... A61G 7/00 5/181
5,179,744 A * 1/1993 Foster ..... A61G 7/00 5/185
6,516,479 B1 * 2/2003 Barbour ..... A47C 19/045 5/152
7,406,729 B2 * 8/2008 Hornbach ..... A61G 7/0509
7,568,247 B2 * 8/2009 Strobel ..... A61G 7/05 5/613
7,676,861 B2 * 3/2010 Ward ..... A61G 1/0212 5/428
7,730,562 B2 * 6/2010 Hornbach ..... A61G 7/05
7,805,782 B2 * 10/2010 Hakamiun ..... A61G 7/0507 5/430
8,239,986 B2 * 8/2012 Heimbrock ..... A61G 7/0521 5/430
8,997,282 B2 * 4/2015 Bossingham ..... A61G 7/002 5/613
9,101,517 B2 * 8/2015 Simmonds ..... A61G 7/0507
9,173,796 B2 * 11/2015 Rigsby ..... A61G 7/0513
9,572,735 B2 * 2/2017 Johnson ..... A61G 7/018
9,622,927 B1 * 4/2017 Edgerton ..... A61G 7/002

(Continued)

*Primary Examiner* — Robert G Santos
(74) *Attorney, Agent, or Firm* — Stephen M. Kepper; Intellectual Property Consulting, LLC

(57) ABSTRACT

A surgical table with independently extendable or foldable side extension platforms (side rails) allowing accommodation of patients with variable physical characteristics. Said surgical table side extension platforms may be operated manually or by electrical or pneumatic actuators and may be controlled by a local or a remote (wireline or wireless connected) controller.

9 Claims, 11 Drawing Sheets

(56) References Cited

U.S. PATENT DOCUMENTS 9,757,293 B2 * 9/2017 Turner ..... A61G 7/002
9,763,840 B2 * 9/2017 Rigsby ..... A61G 7/0524
9,925,102 B2 * 3/2018 Turner ..... A61G 7/0524
10,130,536 B2 * 11/2018 Roussy ..... A61G 7/0512
10,188,569 B2 * 1/2019 Elku ..... A61G 7/0512
10,231,889 B2 * 3/2019 Johnson ..... A61G 7/015
10,357,414 B2 * 7/2019 Bossingham ..... A61G 7/018
10,426,680 B2 * 10/2019 Williams ..... A61G 7/018
10,603,233 B2 * 3/2020 Rigsby ..... A61G 7/05
10,617,583 B1 * 4/2020 Sayed ..... A61G 7/0525
10,716,722 B2 * 7/2020 Roussy ..... A61G 7/0507
10,799,407 B2 * 10/2020 Christie ..... A61G 7/0514
10,842,694 B2 * 11/2020 Roussy ..... A61G 7/002
10,849,804 B2 * 12/2020 Lacasse ..... A61G 7/015
2006/0021142 A1 * 2/2006 Hornbach ..... A61G 7/0509 5/600
2006/0168728 A1 * 8/2006 Strobel ..... A61G 7/0507 5/618
2006/0195984 A1 * 9/2006 HakamiuN ..... A61G 7/051 5/430
2007/0000056 A1 * 1/2007 Ward ..... A61G 1/013 5/611
2008/0282472 A1 * 11/2008 Hornbach ..... A61G 7/0509 5/616
2009/0229051 A1 * 9/2009 Heimbrock ..... A61G 7/0521 5/430
2012/0047654 A1 * 3/2012 Simmonds ..... A61G 7/0521 5/430
2013/0298331 A1 * 11/2013 Bossingham ..... A61G 7/0507 5/613
2014/0047641 A1 * 2/2014 Thodupunuri ..... A61G 7/018 5/613
2014/0215717 A1 * 8/2014 Rigsby ..... A61G 7/05 5/613
2014/0259413 A1 * 9/2014 Johnson ..... A61G 7/015 5/611
2015/0128347 A1 * 5/2015 Hutchison ..... A61G 7/018 5/616
2016/0038360 A1 * 2/2016 Rigsby ..... A61G 7/002 5/613
2016/0193095 A1 * 7/2016 Roussy ..... A61G 7/018 5/11
2017/0027786 A1 * 2/2017 Williams ..... A61G 7/0507
2017/0128294 A1 * 5/2017 Johnson ..... A61G 7/0507
2017/0143566 A1 * 5/2017 Elku ..... A61G 7/012
2017/0252243 A1 * 9/2017 Turner ..... A61G 7/05792
2017/0340497 A1 * 11/2017 Rigsby ..... A61G 7/002
2018/0147101 A1 * 5/2018 Bossingham ..... A61G 7/015
2018/0214326 A1 * 8/2018 Lacasse ..... A61G 7/018
2019/0151170 A1 * 5/2019 Roussy ..... A61G 7/0514
2019/0151171 A1 * 5/2019 Johnson ..... A61G 7/018
2019/0183700 A1 * 6/2019 Roussy ..... A61G 7/0507
2019/0290516 A1 * 9/2019 Christie ..... A61G 7/002
2020/0100963 A1 * 4/2020 O'Leary ..... A61G 7/0513

* cited by examiner (PRIOR ART)

(PRIOR ART)

APPARATUS PROVIDING EXTENSION OF A SURGICAL TABLE WIDTH ALLOWING ADAPTATION TO THE PARAMETERS OF THE SPECIFIC PATIENT

FIELD OF THE INVENTION

This application is a non-provisional application of provisional application No. 62/745,334 titled "Surgical Table with Extendable Width" filed on Oct. 13, 2018, hereby incorporated by reference in its entirety as though fully and completely set forth herein.

The present invention relates to the field of surgical table apparatus designed to allow standard surgical table to be extend laterally to increase the table width, thus accommodating specific patient needs and improving their safety while allowing unrestricted access by the surgical personnel.

To provide such capability a retractable side extension replacing surgical table standard side rails are integrated into the table. Said retractable extension rails may be operated manually or using electro-mechanical actuators. Furthermore, said retractable extension of surgical table can be extended laterally or unfolded from beneath table.

BACKGROUND

The standard width of surgical tables are 20 inches and the standard length is 81 inches, designed to provide support for the average sized patient. With an increase in the number of obese patients, the standard surgical table is no longer adequate to be able to support this population. Prior art list several attempts to account for this growing problem.

In U.S. Pat. No. 5,628,078, Pennington et al. (Pennington), an attempt to address the table width was made by attaching a side extender which is assembled onto the side rail of the surgical table to add approximately 4 inches to one or both sides of the table. This side extender piece can be added to different portions of the table, adding width to the head of the surgical table, torso and/or leg portion. The side extender has another side rail on the outer portion that can be used to hold/secure attachments used during surgery. The problem with this solution is when it is determined a patient is not being adequately supported on the surgical table, operating room staff must leave the operating room and search for these side extensions which are not always easily accessible or available, thus delaying the procedure and increasing the risks.

Furthermore, the solution proposed by Pennington is not secure as the extenders are attached to the table side rail at one or two locations and when any significant pressure is placed on said extenders, they become loose and move position. As a result, surgical attachments often cannot be placed on the side extenders because any movement in the side extender would put a patient's safety at risk.

In U.S. Pat. No. 8,214,951, Batta describes a surgical arm support that is placed under the patient's body, which supports the patient's arms by enclosing them with enveloping leaves which are connected to a board that goes underneath the patient. This solution allows the arms to extend wider than the surgical table, which prohibits adequate support of the patient arms, limits access to the surgical side rails. Thus, if the surgical side rails need to be accessed to place surgical attachments onto, it is impossible if anything is protruding lateral to the edge of the surgical table.

In U.S. Pat. No. 6,678,908 Borders et al. (Borders), describe a bariatric surgical table top that is wider than the standard surgical table thus adding width. This is a separate table top apparatus that overlays the top of the standard table. Requiring a separate table top can be cumbersome to store and carry. Furthermore, it is difficult to determine whether a patient is going to fit onto a standard surgical table by simply looking at them or by knowing their height/weight. It is not uncommon to realize that a patient is not going to be adequately supported by the table after they are already in the operating room and on the table. At this point the patients are often either on sedative medications or asleep. To have them get off the table and wait to have this accessory apparatus be assembled would be difficult and potentially dangerous for the patient.

In U.S. Pat. No. 9,622,927, Edgerton describes a hospital bed that allows for lateral extension to accommodate larger patients. The extensions are four pieces that act unison and pivot with respect to each other. Poulos in U.S. Pat. No. 7,743,441 describes a similar bariatric hospital bed that extends laterally with slides.

None of the prior art allows for easy and efficient variable extension of a specific part of the table to accommodate a specific patient needs, while providing unobstructed access to the surgical table side rails to allow attachment of equipment required for the procedure.

Furthermore, none of the prior art solutions allows setting of the surgical table dimensional parameters remotely by hospital support personnel ahead of the procedure based on the patient's physical characteristics and/or surgical staff instructions.

BRIEF DESCRIPTION OF THE DRAWINGS

A better understanding of the present invention can be obtained when the following detailed description of the preferred embodiment is considered in conjunction with the following drawings, in which.

Figure 1:
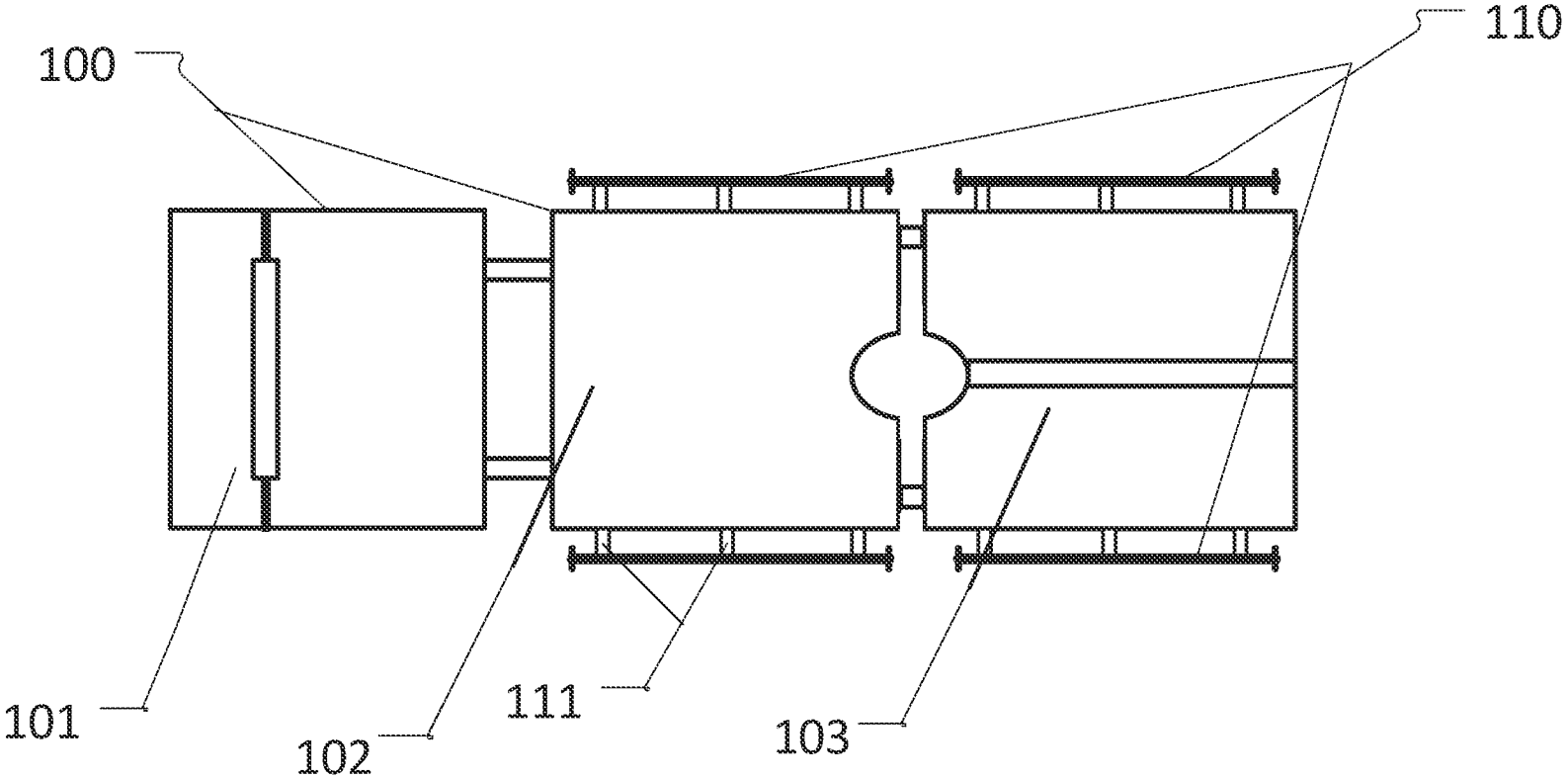
FIG. 1, depicts top view of the surgical table of current invention with the side rails in the recessed (or folded) position, equivalent to the standard surgical table.

While the invention is susceptible to various modifications and alternative forms, specific embodiments thereof are shown by way of example in the drawings and are herein described in detail. It should be understood, however, that the drawings and detailed descriptions are not intended to limit the invention to the particular form disclosed, but on the contrary, the intention is to cover all modifications, equivalents and alternatives falling within the spirit and scope of the present invention as defined by the appended claims.

Glossary of Terms

Application—the term "application" is intended to have the full breadth of its ordinary meaning. The term "application" includes 1) a software program, which may be stored in a memory and is executable by a processor or 2) a hardware configuration program useable for configuring a programmable hardware element.

Computer System—any of various types of computing or processing systems, including mobile terminal, personal computer system (PC), mainframe computer system, workstation, network appliance, internet appliance, personal digital assistant (PDA), television system, grid computing system, or other device or combinations of devices. In general, the term "computer system" can be broadly defined to encompass any device (or combination of devices) having at least one processor that executes instructions from a memory medium.

Remote Computer Terminal—in the scope of this invention any wireless or wireline terminal such as personal computer, tablet, smart-phone, etc.

Graphical User Interface (GUI)—in the context of this invention a graphical representation of surgical table with fields indicating state—extended/not-extended of the table side rail platforms.

Memory Medium—Any of various types of memory devices or storage devices. The term "memory medium" is intended to include an installation medium, e.g., a CD-ROM, floppy disks 104, or tape device; a computer system memory or random access memory such as DRAM, DDR RAM, SRAM, EDO RAM, etc.; or a non-volatile memory such as a magnetic media, e.g., a hard drive, or optical storage. The memory medium may comprise other types of memory as well, or combinations thereof. In addition, the memory medium may be located in a first processor in which the programs are executed, or may be located in a second different processor which connects to the first processor over a network, such as wireless PAN or WMAN network or the Internet. In the latter instance, the second processor may provide program instructions to the first processor for execution. The term "memory medium" may include two or more memory mediums which may reside in different locations, e.g., in different processors that are connected over a network.

Surgical Table Side Rails—in the context of this invention provide a place for the attachment of various medical instrumentation.

Local Area Network (LAN)—in the scope of this invention, is a wireless radio interface such as: WiFi, Bluetooth, ZigBee, etc.

Surgical Table Monitoring System—in the scope of this invention, a system able to collect data related to planar or, angular orientation of surgical table side rails position.

Surgical Table Monitoring System Controller—in the scope of this invention, the control hardware/software, designed to use various mathematical operations: to provide visual representation of side rail location, orientation and force applied to said side rails: to present results of said mathematical calculations on the local or on the remote computer terminal; and to provide adjustments to the side rails position based on the medical personnel inputs; or to perform adjustments of the surgical table siderails independently.

Surgical Table Equipment Parameters—in the context of this invention, surgical table technical parameters, such as: length, width of the surgical table without extended side rails, number and position of extendable side rails, minimum and maximum distances side rails can be extended, incremental pitch of side rail extension, etc.

Patient Parameters—in the context of this invention, it is patient's physical parameters, such as: weight, height, and other physical parameters, entered into the Surgical Table Monitoring System through the User Interface (UI).

Extension Platform—in the context of this invention, an extendable side rail providing support to the patient body, with or without integrated bed padding and which can be extended or unfolded from beneath the surgical table.

Software Program—the term "software program" is intended to have the full breadth of its ordinary meaning, and includes any type of program instructions, code, script and/or data, or combinations thereof, that may be stored in a memory medium and executed by a processor. Exemplary software programs include programs written in text-based programming languages, such as C, C++, Visual C, Java, assembly language, etc.; graphical programs (programs written in graphical programming languages); assembly language programs; programs that have been compiled to machine language; scripts; and other types of executable software. A software program may comprise two or more software programs that interoperate in some manner.

Cloud Server—in the context of this invention is a computing equipment allowing a client application software allowing the Surgical Table Monitoring System to be operated using Internet enabled devices.

Gyroscope—in the context of this invention is a sensor to measure an angular rate of change in device orientation irrespective to gravity.

Force Sensor—in the context of this invention, a sensor (resistive, capacitive, etc.), used to measure pressure (in Newtons) applied to the surgical table side rails.

Moment of Force—in the context of this invention, is a vector which can be described by a vector equation where the force is a vector which position measured from the center to any point along the line of action of the force vector.

Force Vector—in the context of this invention, it is a representation of force which has both magnitude and direction.

Magnitude of Force—in the context of this invention, it is the size of the force vector, which can be computed from the square root of the sum of the squares of its components.

Rotation Matrix—in the context of this invention is a matrix that is used to represent rotation in Euclidean space and to describe device orientation.

Orientation (attitude)—in the context of this invention is an orientation of the device expressed in Euler angles, rotation matrix or quaternion.

Euler Angles—in the context of this invention, angles introduced by Leonhard Euler to describe orientation of a rigid object using sequence of three consecutive rotations.

Quaternion—in the context of this invention is a mathematical expression used to calculate rotation state of the device using the axis and angle of rotation.

Azimuth—in the context of this invention, a horizontal angle measured from any fixed reference plane or easily established base direction line.

SUMMARY OF THE INVENTION

The invention comprises a surgical table with independently extendable or foldable side extension platforms allowing accommodation of patients with variable physical characteristics. Said surgical table side extension platforms may be operated manually or by electrical or pneumatic actuators and may be controlled by a local or a remote (wireline or wireless connected) controller.

When said surgical table characteristics are controlled remotely using wireless or wireline communication, the side extension platform may be positioned to the desired location by the hospital personnel prior to the procedure and even before the patient is present. If a patient's width or length exceeds that of the surgical table when being positioned or if a patient requires more support than that provided by the standard surgical table, the side extension platform can extend laterally or lengthwise at various locations to adequately support the patient.

For example, if the patient's torso is wider than that of the surgical table in its standard position as seen in FIG. 1 the torso portion of the table can be extended to support the patient properly for the given procedure. The extent to which the side extension platform is extended can be determined by visual inspection by the operating room staff helping to position the patient. Alternatively, the patient's physical parameters may be entered into the Surgical Table Monitoring System allowing remote staff to adjust the surgical table side rails to the desired position, or the Surgical Table Monitoring System may independently prepare the surgical table based on the patient's physical parameters—such as: weight, size, and location of the body to be operated on; type of surgical procedure, weight and location of additional equipment and monitors. Based on such information, the Surgical Table Monitoring System may adjust the actual force placed on the side rails after the patient is placed on the table.

Furthermore, the Surgical Table Monitoring System provides visual and audio feedback to the medical personnel about the status of the surgical table side rails—forces, moments present at the side rails and the base of the surgical table, and may perform a corrective action by adjusting the location and/or orientation of the specific side rail position in case the moments along the x or the y axis of the surgical table exceeds the safety thresholds specified in the surgical table parameters. Such corrective action, may be performed autonomously by the Surgical Table Monitoring System, or in form of advice to the medical personnel.

The side extension platform can be extended to different set widths. In a further aspect of the invention, the side extension platform can extend and lock into place at numerous different widths. For example, each side extension platform can extend laterally at 2 cm intervals with locking capabilities and have a maximum extension at 10 cm.

In one embodiment, the side extension platform is contiguous with the side rail, and the side rail acts as the most lateral part of the side extension platform. The mechanism by which the table extends laterally is with a series of parallel extension slides, mounted on the underside of the top of the surgical table 320. In another embodiment, the mechanism by which the table can extend laterally is by unfolding the side extension platform via hinge/pivot mechanism that is stowed underneath the surgical table FIG. 8. Such pivot mechanism may be operated manually or by electromechanical actuators. In case the side rail extension platform is operated using electromechanical actuators, such operation may be controlled locally using appropriate set of switches or may be operated from a remote computer terminal using wireline or wireless communication.

As most surgical tables are comprised of multiple sections to independently support head, torso and lower extremities, these different sections can then extend laterally independently to each other. In addition to being able to extend laterally via the side rails, the portion of the surgical table that supports the head and feet could also extend the length of the surgical table, via the previously described mechanism, to accommodate for taller patients as well.

Once the side rail platform is extended, a surgical table pad is placed in the newly formed space.

All standard mechanical functions of the surgical table are permitted including: elevating the table; rotating the table in Trendelenburg; and reverse Trendelenburg; and rotating/sliding the table to right and to the left. Furthermore, the addition of the side extension platform would still allow for flat x-ray cassette films to pass underneath the top of the table.

The electromechanical actuators used to operate the surgical table side rail extension platforms may be controlled locally using a computer terminal equipped with an appropriate user interface (UI), and software program designed to control the operation of the side rail platforms. Such UI, may be in form of a graphical user interface (GUI), where the fields representing side rail platforms are indicating status of the specific section—such as extended; not-extended; folded, etc. Specific operations, such as extend or fold may be performed by touching the field representing the desired side rail section. When this side rail section obtains desired position, the color of this field icon may change indicating change of status of said section. To perform such operations, beside the electromechanical actuators used to extend or unfold the side rail platforms, a set of sensors designed to monitor position and/or orientation of the side rails and/or the entire table computer software able to monitor and control surgical table operations may be required.

Such sensors may monitor the position of the side rails, for example completely or partially extended, or in the case of folding side rail, an angle of the rotating arm. In addition, said sensors may provide information on the force applied to the extended side rail thus providing additional safety to the patient.

The surgical table monitoring software may reside on the local computer terminal attached to or located near the surgical table and communicating with the sensors and actuators using wire interface, or may be located remotely and communicate with the sensors and actuators using wireless communication—such as WiFi, Bluetooth, etc.

DETAILED DESCRIPTION OF INVENTION

Figure 2:
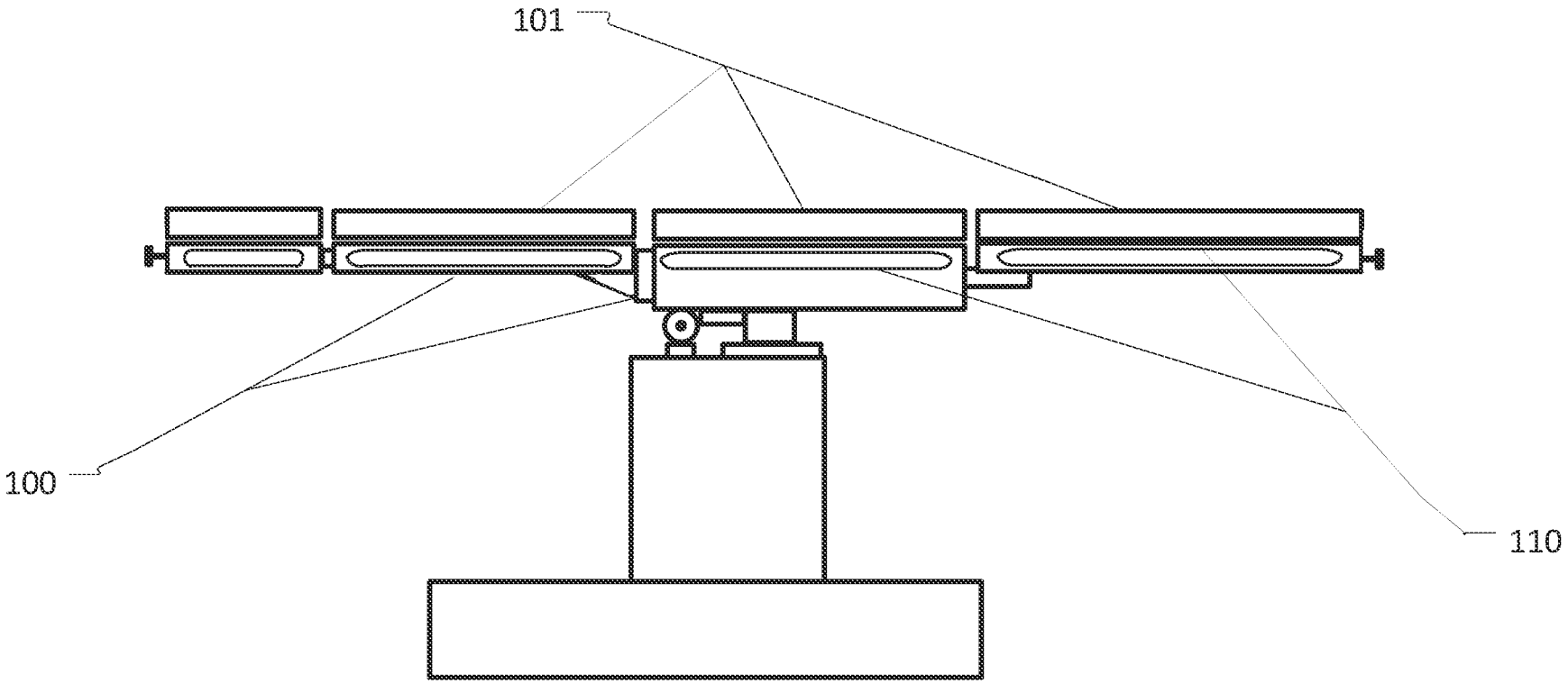
FIG. 2, depicts side view along the longitudinal axis of the surgical table of current invention.

The surgical table of the present art is presented in FIG. 1 and FIG. 2 for top view and side respectively. It can be seen that the table 100, is comprised of three sections—101 for support of a patient's head, 102 for support of the patient's torso, and 103 for support of the patient's lower part of the body. Those three sections can be independently positioned, they are connected and assembled on a common platform or stand. Some or all of the surgical table sections are equipped with side rails 110; 111 for the right side of the surgical table. Those side rails are used for support of the various medical instruments used during the surgical procedures, and in the surgical tables of the prior art, said side rails are permanent and can't be adjusted.

With the continued increase in the obese population, surgical tables of the present art are frequently inadequate to provide comfort and safety to the patient with unimpeded access to the surgical side rails for surgical accessory equipment. The present invention intends to mitigate this problem by providing extendable side rail platforms at each side of the surgical table, where each side rail platform may be adjusted independently, thus providing adequate support for the selected part of the patient without impeding access to the side rails.

Figure 3:
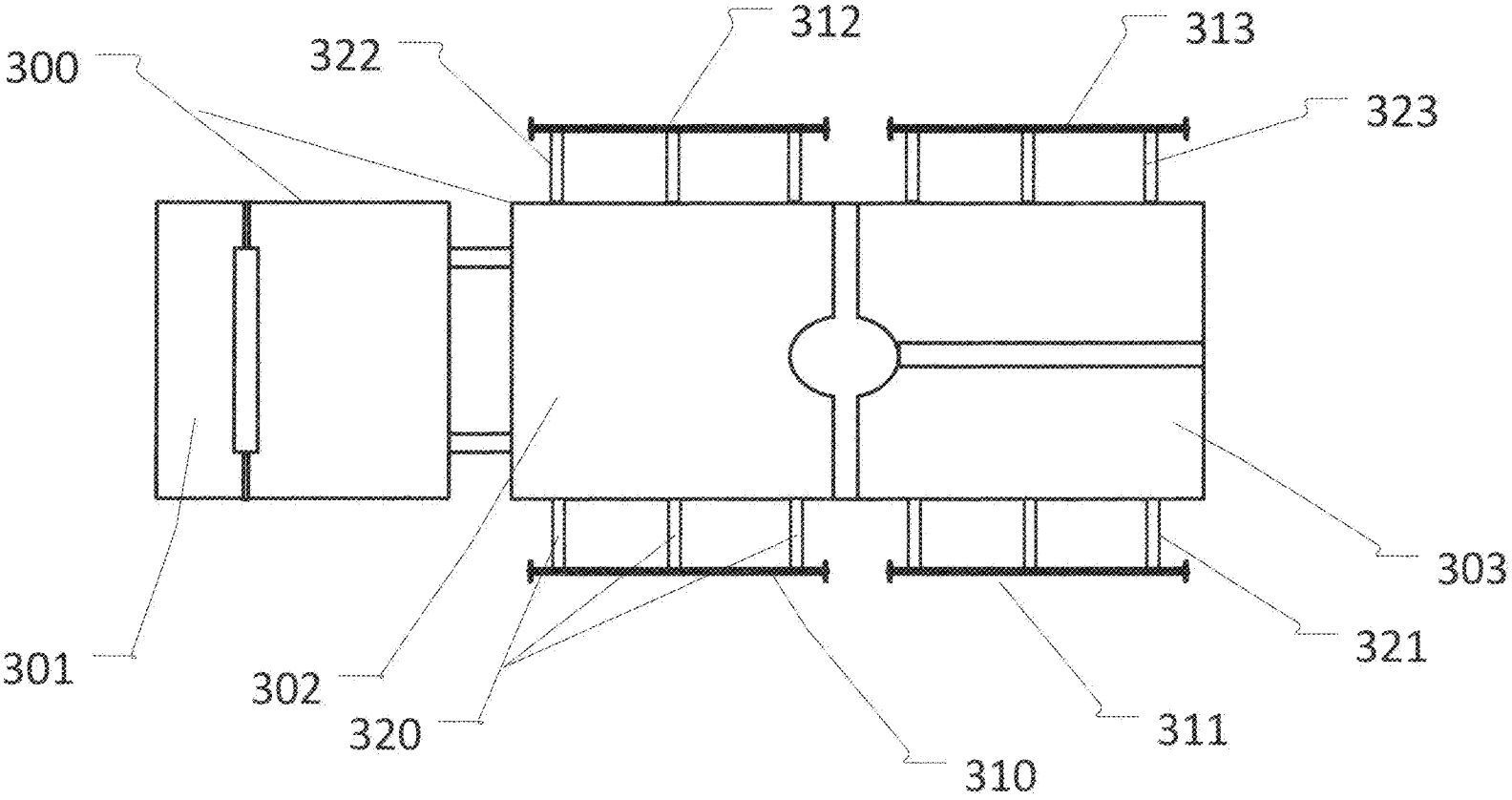
FIG. 3, depicts top view of the surgical table of current invention with the center and lower-body side rails in the extracted (or unfolded) position.
Figure 4:
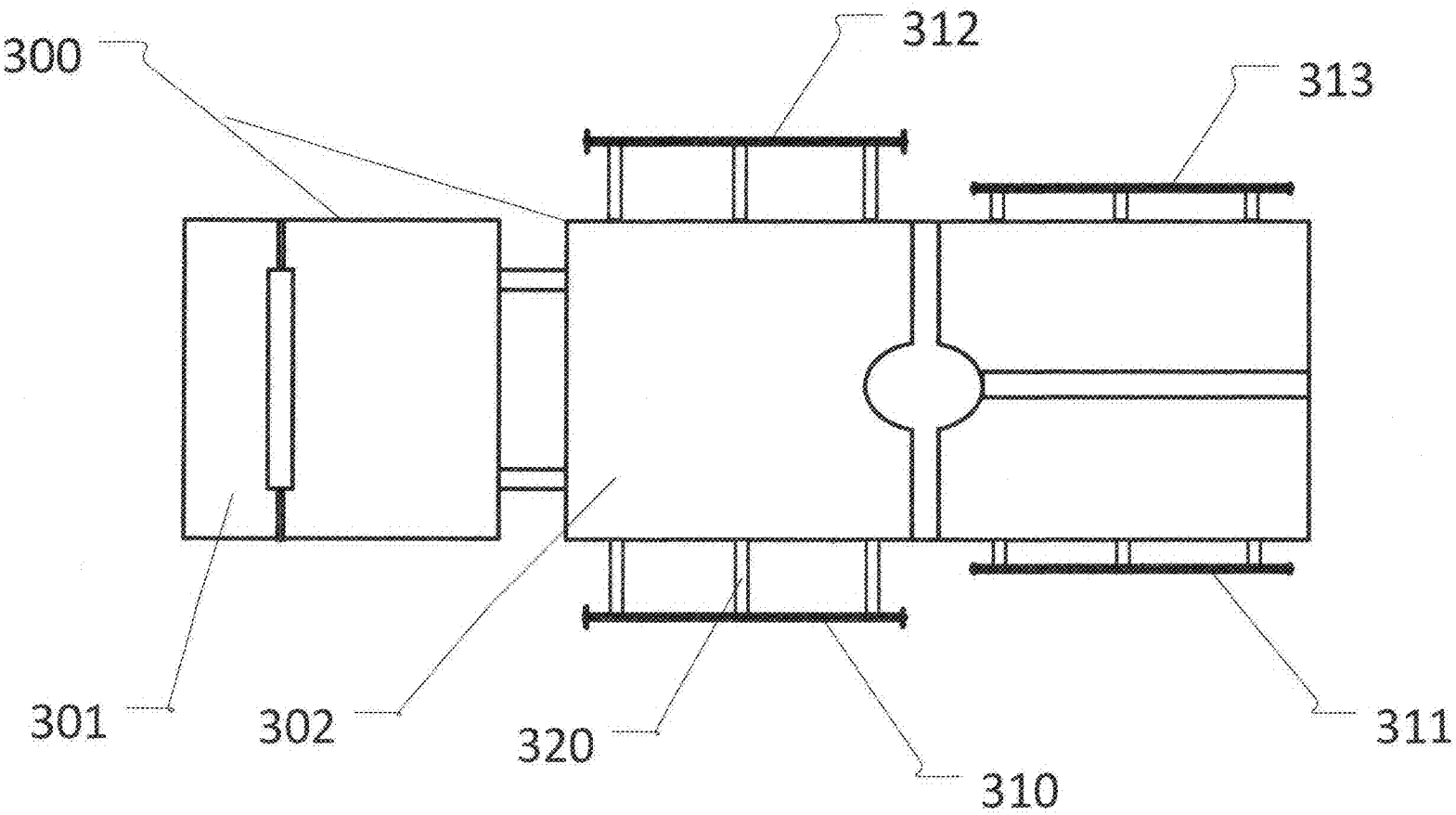
FIG. 4, depicts top view of the surgical table of current invention in which only the center body side rails are the extracted (or unfolded) position, while remaining side rails are recessed (or folded)
Figure 5:
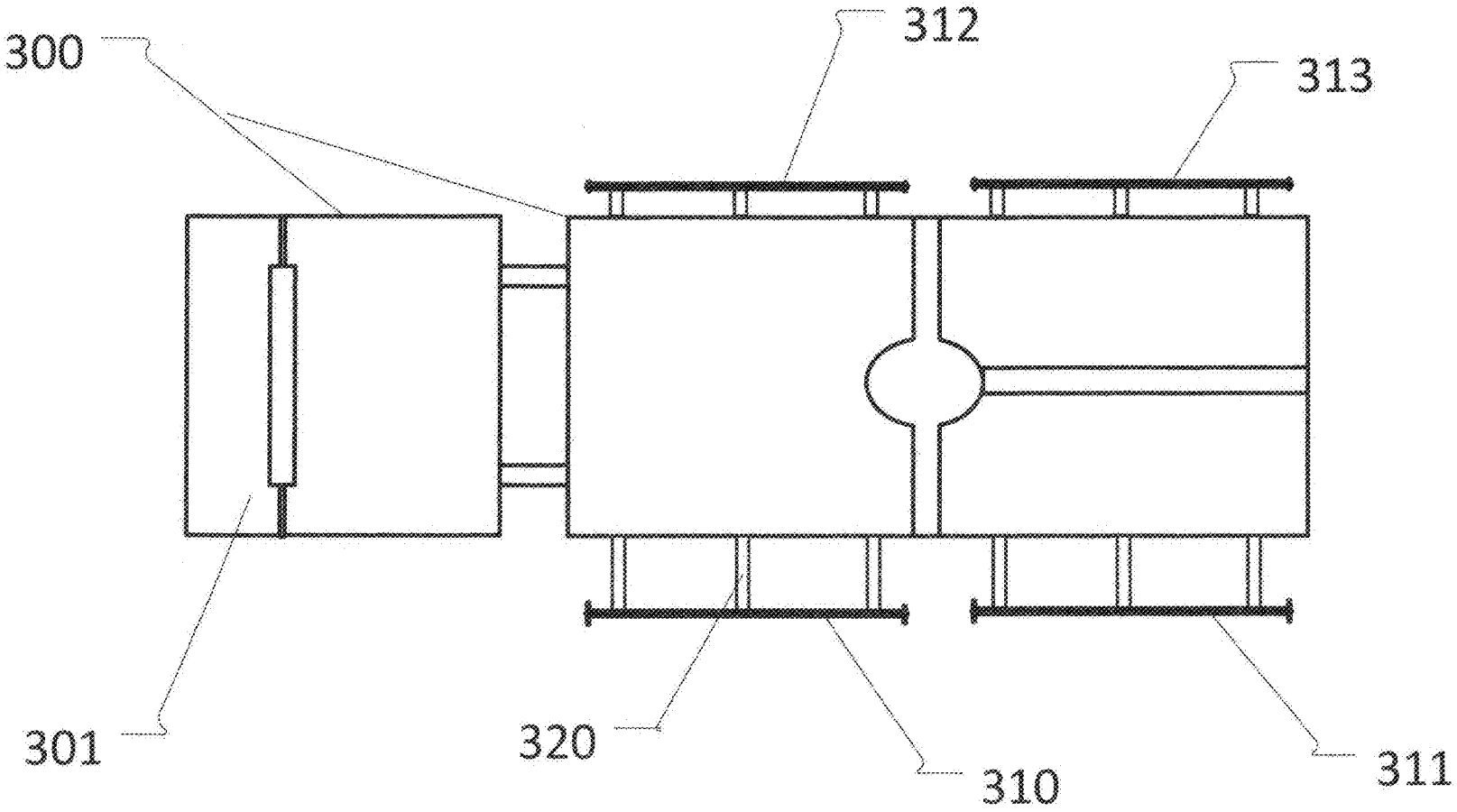
FIG. 5, depicts top view of the surgical table of current invention in which the center body and lower body side rail on one side are the extracted (or unfolded) position, while remaining side rails are recessed (or folded)
Figure 6:
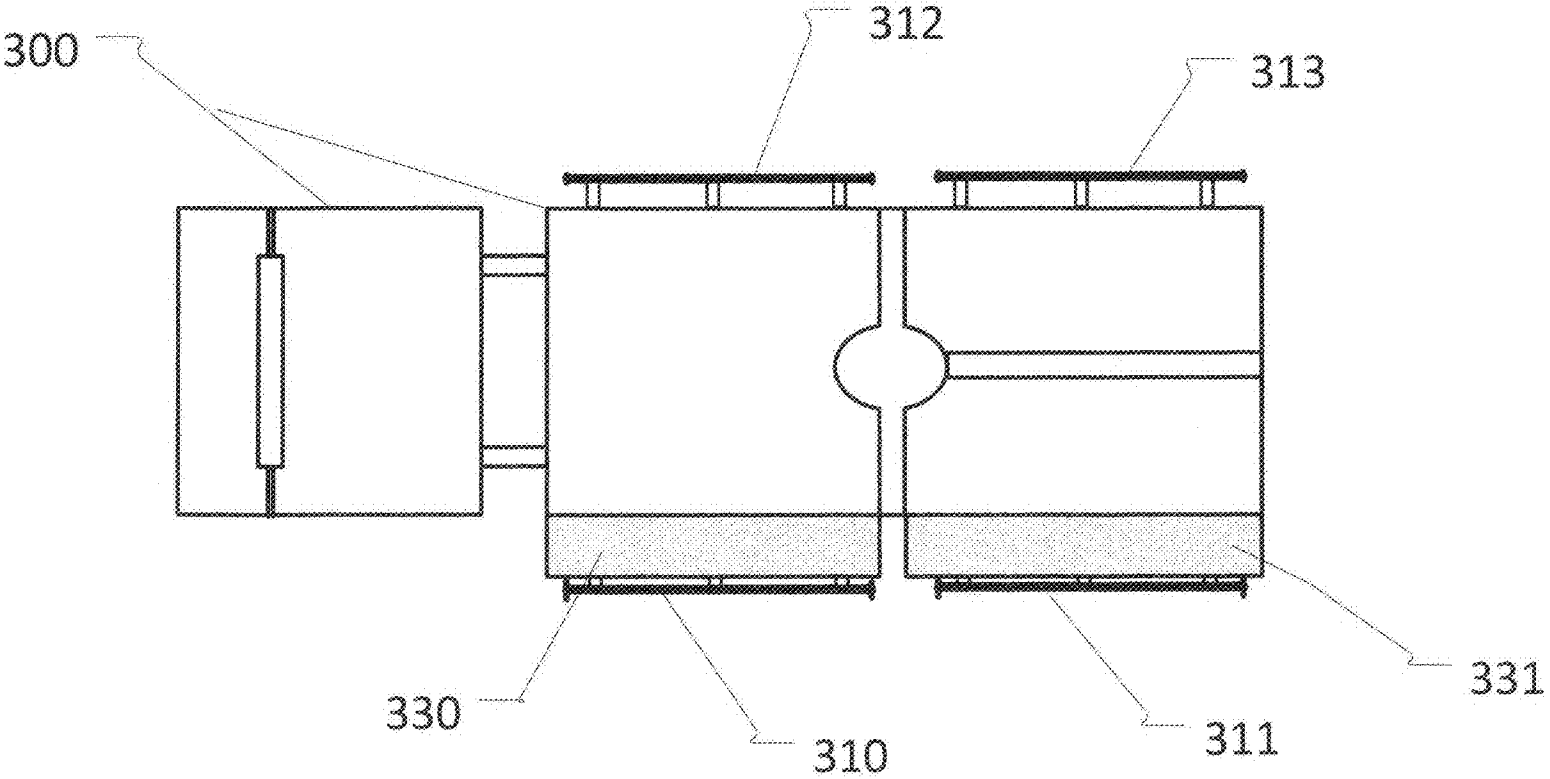
FIG. 6, depicts top view of the surgical table of current invention in which two rails-rail are in the extracted (or unfolded) position and fitted with the surgical table mats, while remaining side rails are recessed (or folded)

The surgical table of the present invention is presented in FIGS. 3 through 10. FIG. 3 represents the top view of the table. Here the exemplary surgical table 300 also comprised of three sections—301 supporting patient's upper body and or head; 302 to support the torso and 303 to provide support of the lower body. The 302 and 303 surgical table sections are equipped with side rails 310 and 311 on the right side of the torso section 302 and lower section 303 of the table respectively, and side rails 312 and 313, for the left side of the torso section 302 and lower section 303 of the table respectively. Furthermore, the side rails 310, 311, 312 and 313 are attached to the torso section 302 and lower body section 303 by an extendable side rail arms 320, 321, 322 and 323.

The side rails 310, 311, 312, and 313 may be independently extended. This feature is presented in FIGS. 4 and 5. On FIG. 4, the torso section 302 right side rail 310 and left side rail 312 are extending the upper torso section. On FIG. 5, the right side rail 310 and 311 are extended, while the side rails 312 and 313 are not extended. When the space between the extended side rail sections of the surgical table in filled with an appropriate surgical table padding—330 and 331 in FIG. 6, the specific portion of the surgical table becomes significantly wider. This can then provide support for a larger patient and when necessary, can make adjusting the patient position easier, while at the same time providing all the standard benefits of the surgical table side rails.

Figure 7:
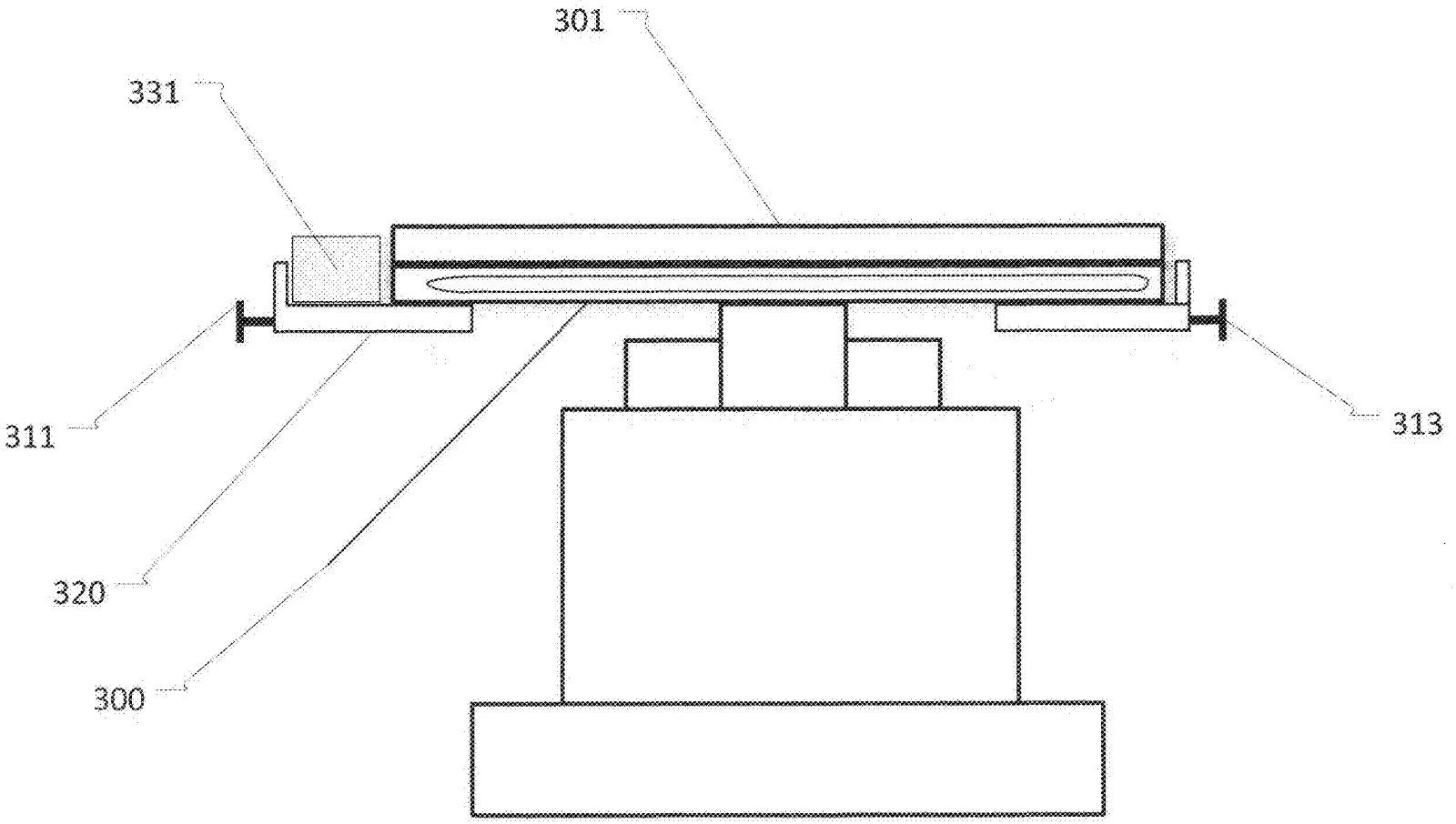
FIG. 7, depicts the transversal side view of the surgical table of current invention in which one of the extracted (or unfolded) side rail is fitted with the surgical table mats, while remaining side rails are recessed (or folded)

FIG. 7 presents foot side view of the surgical table of the present invention. Here, the right side rail 311, of the lower body section of the surgical table 300, is extended on sliding arms 320, and the surgical table pad extension 331 is placed in the space between the edge of surgical table 300 and the side rail 311, while the left side rail 313 is in the retracted position.

Figure 8A:
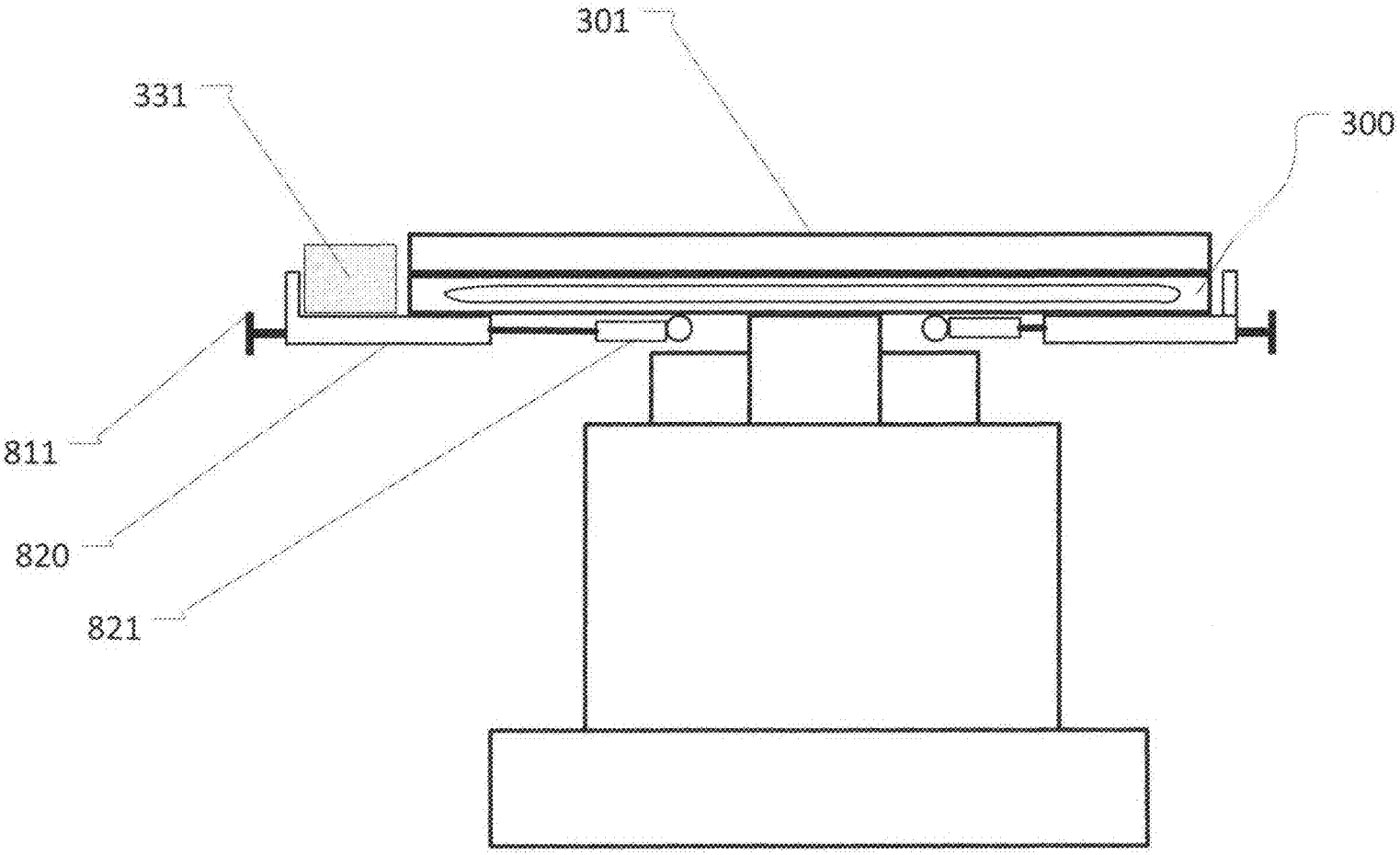
FIG. 8A, depicts the transversal side view of the surgical table of current invention in which the side rails operated by electromechanical actuators slide horizontally from under the surgical table.
Figure 8B:
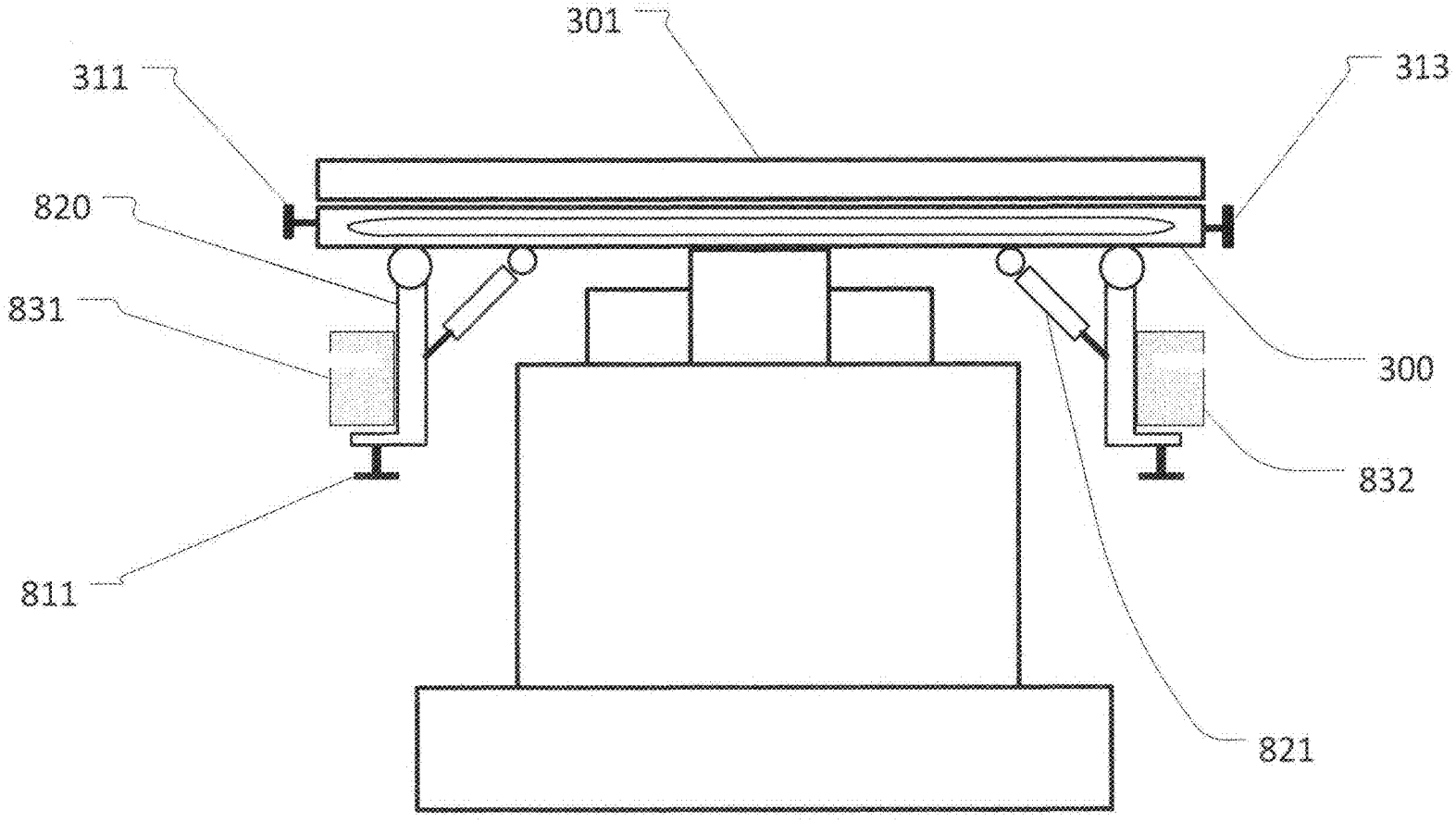
FIG. 8B, depicts the transversal side view of the surgical table of current invention in which the side rails operated by electromechanical actuators are folded under the surgical table and the surgical table side rails fitted with the surgical table mats.

In FIGS. 8A and 8B, an embodiment comprising the surgical table of the present invention in which, the extendable side rails are operated by electromechanical actuators.

In FIG. 8A, said electromechanical actuators 821, operating the side rails 811 and attached to supporting rails 820, slide from under the surgical table 300. When the side rail is extended, a surgical table pad 331, is placed in the designated space between the extended side rail and the standard surgical table pad 301.

In the FIG. 8B, the electromechanical actuator 821 is folded under the surgical table 300. In such arrangement, the surgical table pad extensions 831 and 832, may be permanently attached to the extendable side rails arms 820, if the surgical table pad extensions are profiled in such a way as to embrace the standard surgical table side rails 311 and 313.

The asymmetrical extension of one particular section of the surgical table may create the surgical table imbalance problems with a heavy patient. To adjust for this, location, orientation and moment sensors—such as a MEMS gyroscope and a force/pressure sensor may be placed in the extension arms. In such surgical table configuration, the MEMS gyroscope and accelerometer will record side rail position in a 3D space and a resistive or capacitive pressure sensors provide the measurement of force. The orientation, force vectors and their magnitude recorded by said sensors are sent to the table controller which calculates moments applied to the extended side rail. If the applied moment—patient mass times the extended side rail length times the side rail ($\tan \theta = y/x$), exceeds the predefined safety threshold and affects table balance, the side rail orientation is adjusted.

In an embodiment when the surgical table side rails are operated via an electromechanical actuator, the side rails' position are controlled using an electronic controller or a computer terminal equipped with a specifically designed software. Said computer terminal may be co-located with the surgical table or located remotely, communicating with the table actuators using wireless Local Area Network (LAN), such as WiFi, etc. Such remote location of the controlling device allows the functions of the table to be prepared by medical personnel according the procedure requirements ahead of time, thus streamlining the process. When said table is equipped with orientation and force sensors that monitor position and forces applied to the side rails, the surgical table controller can monitor weight imbalances and ensure surgical table stability.

Figure 9:
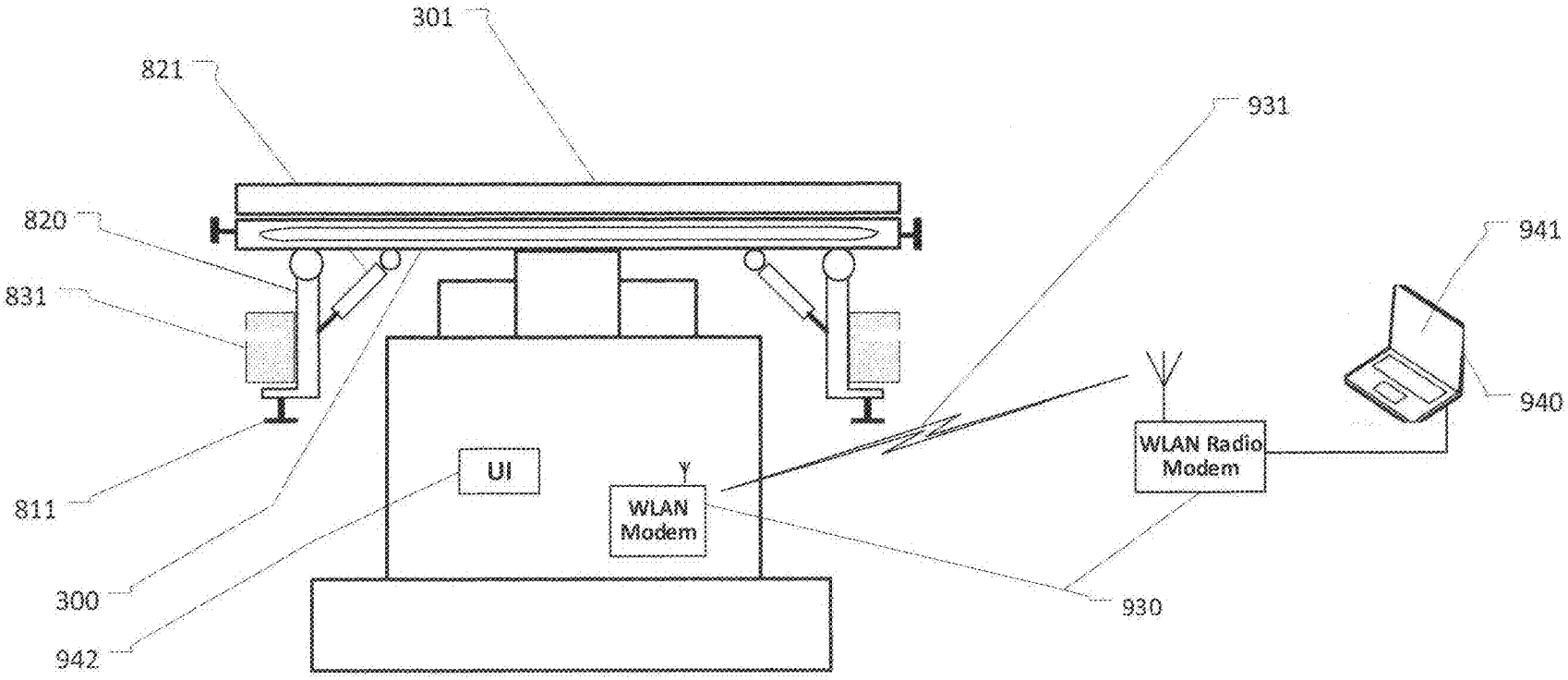
FIG. 9, depicts the transversal side view of the surgical table of current invention where the position for the side rails is controlled locally through the local control panel or from a remote terminal using wireless interface.

A surgical table of the current invention which functionality is controlled remotely using the wireless communication link and the side rails are operated via electromechanical actuators is presented in FIG. 9. Here the surgical table 300, the side rails arm 820 equipped with the side rail extension pad 831, and side rail 811, is operated via an electromechanical actuator 821. The surgical table 300, and surgical table side rail arms 820, functionality are controlled by the remote controller 940 communicating with the surgical table using wireless LAN modems 930, over the wireless interface 931. The table wireless LAN modem may be equipped with local—to the table User Interface (UI) 942, to provide additional functionality and safety. The status of the table is displayed on both and the local UI 942 and on the remote UI 941, and the functionality of the table is controlled via the remote controller U 1941 and the local controller 942.

Figure 10:
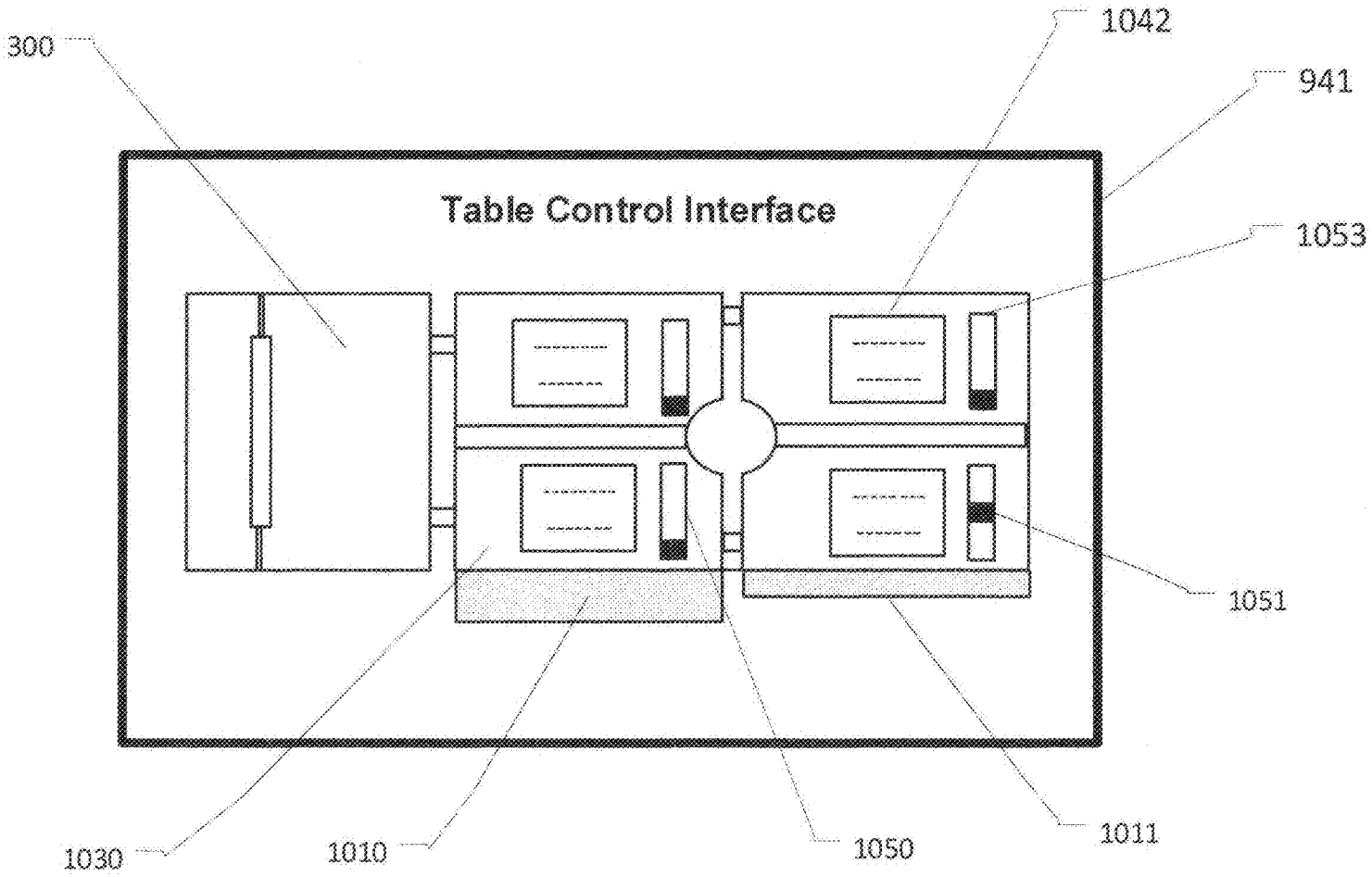
FIG. 10, presents an exemplary graphical User Interface (UI) of the surgical table remote control terminal.

An exemplary control and status UI of the surgical table of the current invention is presented on FIG. 10. Here the remote terminal UI 941 presents graphical representation of the surgical table 300. The status of the table side rails is displayed in a numerical form field 1042, and graphically in fields 1010 and 1050 for the right upper torso section of the surgical table; 1011 and 1051, for the right lower torso section of the surgical table; and 1053 for the left lower torso section. The side rail of the right side of the upper torso section of the surgical table is fully extended, while the side rail of the right side of the lower torso section is only extended partially and all side rails of the left side are not extended. The side rail positions are controlled via sliding an image of a potentiometer; here the sliding potentiometer 1051 controlling the right side lower torso section side rail is in the center position indicating partially extended side rail, while the potentiometer 1050 controlling the right side upper torso side rail is fully extended and potentiometers controlling the left side of the surgical table are in OFF position—indicating side rails are not extended. The numerical data presented on the surgical table section status window 1042, may provide information about the orientation of the side rails, moments applied to the side rails, overall balance of the surgical table, etc.

What has been described above includes examples of aspects of the claimed subject matter. It is, of course, not possible to describe every conceivable, combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes", "has" or "having" are used in either the detailed description or the claims, such terms are intended to be inclusive in a manner similar to the term "comprising" as "comprising" is interpreted when employed as a transitional word in a claim.

It is understood that the specific order or hierarchy of steps in the processes disclosed is an example of exemplary approaches. Based upon design preferences, it is understood that the specific order or hierarchy of steps in the processes may be rearranged while remaining within the scope of the present disclosure. The accompanying method claims present elements of the various steps in a sample order, and are not meant to be limited to the specific order or hierarchy presented.

Those of skill in the art would understand that information and signals may be represented using any of a variety of different technologies and techniques. For example, data, instructions, commands, information, signals, symbols, etc. may be referenced throughout the above description by other means.

Those of skill would further appreciate that the various illustrative logical blocks, modules, and algorithmic steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

I claim:

1. A surgical table comprising an upper section, torso section, and lower section, wherein each section has an opposing right side and left side, said torso section comprising an extendable side rail attached to the right and left side of said torso section, and said lower section comprising an extendable side rail attached to the right and left side of said lower section, an electromechanical actuator operable to adjust the position of said extendable side rails, a surgical table monitoring system comprising a plurality of sensors that are operable to measure the position, orientation, and force applied to said extendable side rails, and a controller in communication with said surgical table monitoring system and said electromechanical actuator, wherein said controller is operable to receive data from said surgical table monitoring system and determine whether the load applied at each said side rail exceeds a predefined threshold, wherein, when the load exceeds said predefined threshold, said controller autonomously controls said electromechanical actuator to reposition the extendable side rails within said predefined threshold.

2. The surgical table of claim 1 wherein each of the said extendable side rails are operable to extend independently of the other side rails.

3. The surgical table of claim 1 wherein said plurality of sensors comprise a three-axis gyroscope, a three-axis accelerometer, and a pressure sensor, wherein said surgical table monitoring system is operable to receive vectors from said three-axis gyroscope, said three-axis accelerometer, and said pressure sensor and determine the location of said side rails and moment of force applied to each said side rails, wherein said pre-defined threshold is determined by comparing said moment of force applied to said side rails with technical parameters of said surgical table.

4. The surgical table of claim 1 comprising a graphical user interface operable to depict a graphical representation of the surgical table and the position of the extendable side rails.

5. The surgical table of claim 1 wherein the controller comprises a graphical user interface operable to depict a graphical representation of the surgical table and the position of the extendable side rails.

6. The surgical table of claim 5 wherein the controller is operable to communicate with said surgical table monitoring system and said electromechanical actuator using wireless means of communication.

7. The surgical table of claim 1 wherein the surgical table is operable to provide notifications when the forces applied to the extendable side rails exceeds a predefined safety threshold.

8. The surgical table of claim 7 wherein the notifications comprise video signals.

9. The surgical table of claim 7 wherein the notifications comprise audio signals.

* * * * *